US006471133B1

(12) United States Patent
O'Flynn et al.

(10) Patent No.: US 6,471,133 B1
(45) Date of Patent: Oct. 29, 2002

(54) COMBINATION RADIATOR AND THERMOSTAT ASSEMBLY

(75) Inventors: Kevin P. O'Flynn, Canton, MI (US); Michael Bruno Magnan, Dearborn, MI (US); Valerie Anne Nelson, Livonia, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/682,702

(22) Filed: Oct. 8, 2001

(51) Int. Cl.[7] ..... F01P 7/02; F01L 13/02
(52) U.S. Cl. ..... 236/34.5; 123/41.1
(58) Field of Search ..... 236/34, 34.5; 123/41.1

(56) References Cited

U.S. PATENT DOCUMENTS 4,344,564 A * 8/1982 Magnuson ..... 236/34.5
4,432,410 A 2/1984 Cadars
4,456,167 A * 6/1984 Buter ..... 236/100
4,748,941 A * 6/1988 Kashiwase ..... 123/41.1
5,018,664 A * 5/1991 Butler ..... 236/34.5
5,092,521 A 3/1992 Brown
5,139,080 A 8/1992 Bolton et al.
5,238,185 A * 8/1993 Saur et al. ..... 236/34.5
5,305,826 A 4/1994 Couëtoux
5,529,026 A * 6/1996 Kurr et al. ..... 12/41.1
5,607,104 A * 3/1997 Naclerio et al. ..... 236/34.5
5,996,684 A 12/1999 Clifton et al.

* cited by examiner

*Primary Examiner*—William E. Tapolcai
(74) *Attorney, Agent, or Firm*—Diana D. Brehob

(57) ABSTRACT

A thermostat cartridge assembly 14 for a cooling system 10 of an automotive vehicle 12 including a housing 50. The housing 50 includes a first opening 62, a second opening 68, and a direct-flow opening 72. A thermostat mechanism 80 located at least partially within the housing 50 adjusts the amount of coolant flowing between the first opening 62, the second opening 68, and the direct-flow opening 72. An attachment mechanism 52 attaches the thermostat cartridge assembly 14 to the cooling system 10. A releasing mechanism 54 engages and disengages the thermostat cartridge assembly 14 to and from the cooling system 10.

13 Claims, 5 Drawing Sheets

COMBINATION RADIATOR AND THERMOSTAT ASSEMBLY

BACKGROUND OF INVENTION

The present invention relates generally to automotive cooling systems, and more particularly to an apparatus that incorporates the functions of a radiator and a thermostat into a single housing.

Current automotive cooling systems are composed of distinct elements including a radiator, which acts as a heat exchanger, and a separate engine mounted thermostat. The thermostat allows coolant to flow through the radiator when the coolant is above a predetermined temperature. Three most commonly used radiator styles are a downflow design, a crossflow design, and a U-flow design.

In the radiator downflow design, the radiator has an upper tank and a lower tank, with the two tanks being connected by a member having an array of finned tubes. Hot coolant flows through a side tube into the upper tank, through the normal array of finned tubes from the upper tank to the lower tank where the water is cooled, and exits the radiator at the lower tank through a second side tube.

In the crossflow design, the radiator includes left and right side tanks, which are connected by a set of finned tubes. Coolant typically flows in the top of the right side tank, flows across the set of finned tubes, and exits the radiator through a lower portion of the left side tank.

The U-flow radiator design is similar to the crossflow design. The U-flow design includes left and right side tanks, which are connected by an upper and a lower set of finned tubes. Coolant typically flows in the top of the right side tank, across the upper set of finned tubes to the left side tank, and returns to the right side tank through the lower set of finned tubes.

In the downflow and crossflow designs, coolant enters one side of the radiator and exits a different side of the radiator as opposed to the U-flow design, which allows the coolant to enter and exit the same side of the radiator.

All three of these designs have a separately located thermostat, apart from the radiator. The thermostat is fluidically coupled to the radiator by additional connections. In order for the thermostat to be removed or replaced, tools are required and the coolant needs to be drained from the cooling system. When the thermostat is reinstalled or replaced, contact surfaces between the thermostat and the engine need to be cleaned, which may include scraping off any remaining gasket material. Also in replacing the thermostat, new gasket material is required to properly seal the contact services. Therefore, removal and replacement of the thermostat is time consuming and therefore costly.

In U.S. Pat. Nos. 4,432,410 and 5,305,826 a temperature sensitive valve is used within the left side tank of a U-flow design radiator. The '410 patent describes a temperature sensitive valve that acts as a traditional thermostat in that it permits coolant to flow through the left side tank when the coolant temperature is below a predetermined temperature. When the coolant is above a predetermined temperature, the temperature sensitive valve changes the coolant flow direction, such that the coolant flows in an upper portion of the left side tank, across the finned tubes, and than exits a lower portion of the left side tank. The temperature sensitive valve in the '826 patent is regulated such that the valve adjusts the amount of coolant that is permitted to flow across the finned tubes and how much remains flowing only through the left side tank. Both the '410 and '826 temperature sensitive valves are difficult to remove and replace, and therefore costly to repair. In order to repair either valve, the coolant needs to be drained from the cooling system, causing additional time and expense. Also when initially filling the cooling system, if the system temperature is not above a predetermined value and the valves are not completely open in either the '410 patent or the '826 patent, there is a potential for air gaps to ensue because of the valves restricting coolant flow. Air gaps can cause hot spots in the cooling system, which in turn may cause degradation of engine and cooling system components. In order to assure that the valves are completely open to prevent air gaps, time is needed to heat the coolant.

It would therefore be desirable to develop an automotive cooling system that is quick and easy to fill without a potential for air gaps, has a minimal amount of components, has a thermostat that is easy to replace, and is of low cost to produce.

SUMMARY OF INVENTION

The forgoing and other advantages are provided by an apparatus that incorporates the functions of a radiator and a thermostat into a single housing. A thermostat cartridge assembly for a cooling system of an automotive vehicle is provided including a housing. The housing includes a first opening, a second opening, and a direct-flow opening. A thermostat mechanism located at least partially within the housing adjusts the amount of the coolant flowing between the first opening, the second opening, and the direct-flow opening. An attachment mechanism attaches the thermostat cartridge assembly to the cooling system. A releasing mechanism attaches and disengages the thermostat cartridge assembly to and from the radiator.

One advantage of the present invention is that the thermostat may be removed or replaced without draining coolant in the cooling system, thereby saving costs involved in disposal and purchasing of coolant.

Another advantage of the present invention is that the thermostat is easily removable and replaceable without tools or gasket scraping.

Yet another advantage of the present invention is that during initial filling of the cooling system, since the thermostat is easily removable, the cooling system may be easily and completely filled, in a minimum amount of time without leaving air gaps in the cooling system.

The above mentioned advantages alone save costs in manufacturing, producing, and usage of the automotive vehicle cooling system.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

Figure 1:
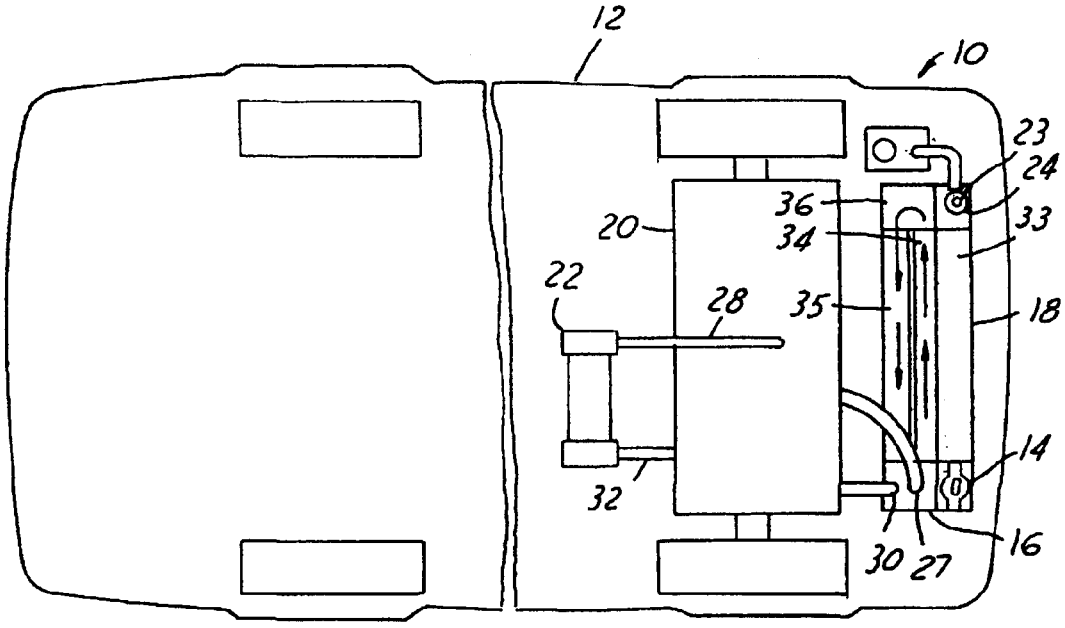
FIG. 1 is a block diagrammatic view of a cooling system of an automotive vehicle using a thermostat cartridge assembly within a right-hand bypass tank of a U-flow radiator in accordance with an embodiment of the present invention.

In each of the following figures, the same reference numerals are used to refer to the same components. While the present invention is described with respect to an apparatus that incorporates the functions of a radiator and a thermostat into a single housing the following apparatus is capable of being adapted for various purposes and is not limited to the following applications: automotive cooling systems, residential or commercial cooling systems, or other liquid based systems that require regulation of fluid flow.

In the following description, various operating parameters and components are described for one constructed embodiment. These specific parameters and components are included as examples and are not meant to be limiting.

Referring now to FIG. 1, a block diagrammatic view of a cooling system 10 of an automotive vehicle 12 using a thermostat cartridge assembly 14 within a right-hand bypass tank 16 of a U-flow radiator 18 in accordance with an embodiment of the present invention is shown. The radiator 18 lowers the temperature of coolant in the cooling system 10. The coolant passes through the radiator 18, then to an engine 20 where heat from the engine 20 is transferred to the coolant, thereby, cooling the engine 20. The coolant is then transferred to a heater core 22 for heating an inner cabin (not shown) of the vehicle 12 and finally cycled back to the radiator 18. A pressure relief valve 23 is incorporated in a radiator cap 24 to relief pressure in the cooling system 10, which allows coolant to flow into reservoir 25. The pressure relief valve 23 may be in various locations of the cooling system 10 as know in the art. Although the pressure relief valve 23 is shown as part of the radiator cap 24, it may be incorporated into the thermostat cartridge assembly 14 using methods known in the art, thereby eliminating the radiator cap 24.

Coolant enters the assembly 14 through an intake hole 27 by way of hose 28 and either flows through the bypass tank 16 to an exit hole 30 and into hose 32 or is directed across a cooling mechanism 33. When the coolant is directed across the cooling mechanism 33 the coolant is transferred across an upper set of finned tubes 34 to an end tank 36 and returns to the bypass tank 16 across a lower set of finned tubes 35 to exit the radiator 18 through tube 32 where it then enters engine 20. Although the cooling mechanism 33 of the present invention is the upper set of finned tubes 34 and the lower set of finned tubes 35 other cooling mechanisms known in the art may be used.

Figure 2:
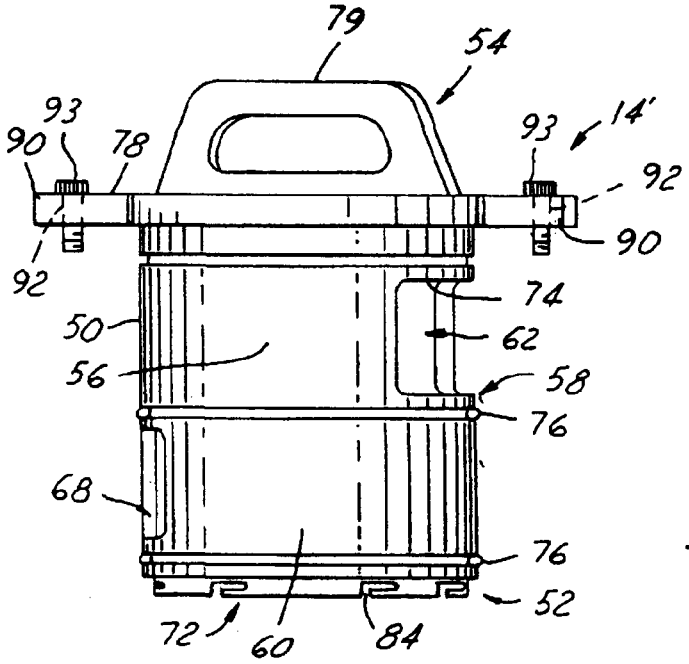
FIG. 2 is a side perspective view of a dual-opening thermostat cartridge assembly in accordance with an embodiment of the present invention.
Figure 3A:
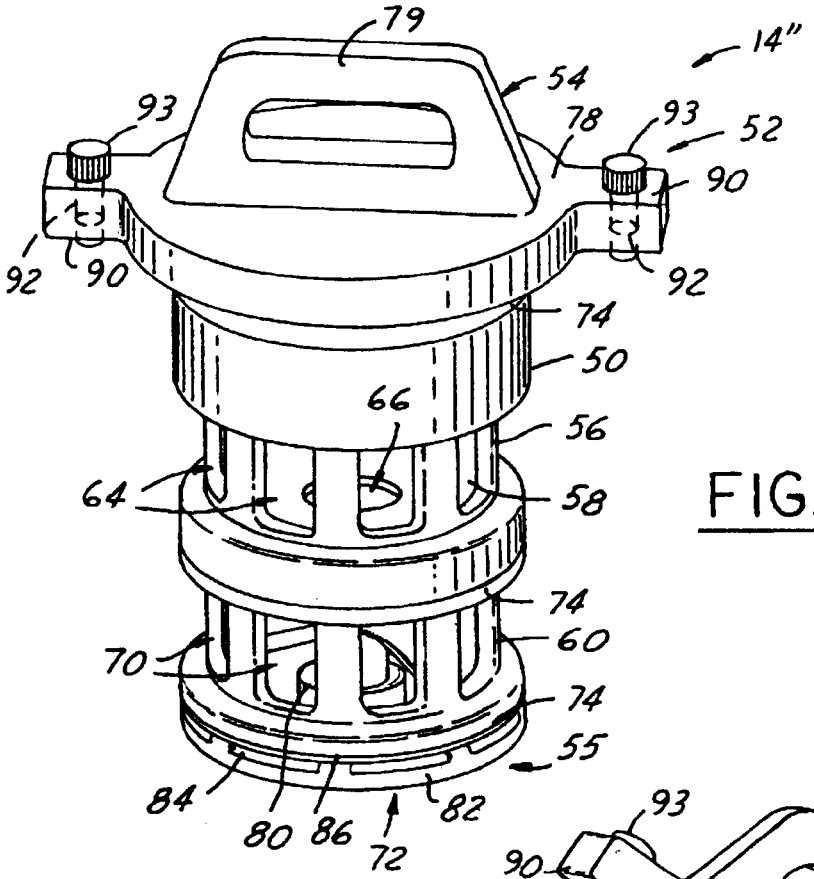
FIG. 3A is a top perspective view of a slotted thermostat cartridge assembly in accordance with an embodiment of the present invention.
Figure 3B:
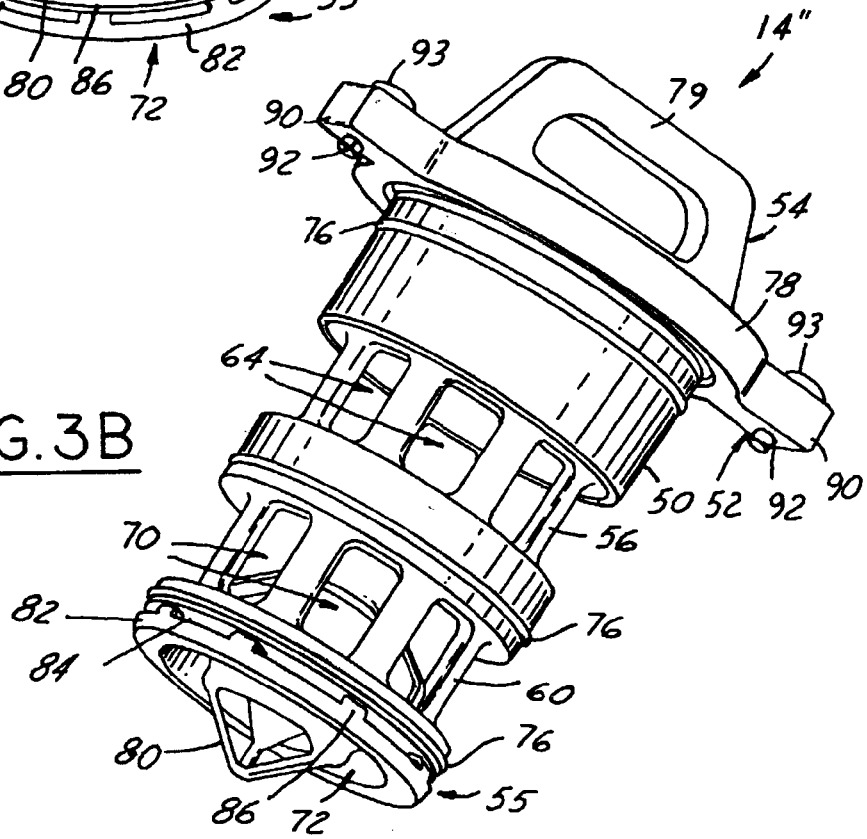
FIG. 3B is a bottom perspective view of the slotted thermostat cartridge assembly in accordance with an embodiment of the present invention.

FIG. 2 is a perspective view of a dual-opening thermostat cartridge assembly 14", and FIGS. 3A and 3B are perspective views of a slotted thermostat cartridge assembly 14"", all as shown in accordance with embodiments of the present invention. The assembly 14 includes a housing 50, having an attaching mechanism 52 and a releasing mechanism 54, and a thermostat retaining mechanism 55.

The housing 50, although as illustrated is cylindrical in shape, the housing 50 may be of various shapes, styles, and sizes. The housing 50 includes a first portion 56, a center wall 58, and a second portion 60. The first portion 56 may include a first opening 62, as best illustrated in FIG. 2, or may include a first set of slots 64, as best illustrated in FIGS. 3A and 3B, for coolant to flow through. The center wall 58 separates the first portion 56 from the second portion 60. The center wall 58 has a center opening 66, as best illustrated in FIG. 3A, for coolant to flow between the first portion 56 and the second portion 60. The second portion 60 may have a second opening 68, as shown in FIG. 2, or may have an second set of slots 70, as shown in FIGS. 3*a* and 3*b,* for coolant to pass through the second portion 60. The second portion 60 also has a direct-flow opening 72 for coolant to flow to or from the finned tubes 34 and 35. The housing 50 has several groves 74 for "O-rings" 76 to sit into. The O-rings 76 seal and prevent coolant from escaping through the cap 78 and other internal components of the radiator 18. The housing 50 and cap 78 may be an integrated unitary body as illustrated or may be composed of several separate components. The housing 50 and cap 78 may be produced from but is not limited to any of the following rigid materials: stiff rubber, elastomers, synthetics, plastic, polyvinyl chloride, polyvinyl acetate, polypropylene, polyethylene, steel, alluminum, graphite, ceramic, or other feasible material known in the art.

The attaching mechanism 52 includes the cap 78 having two extending tabs 90 and two holes 91 for two threaded fasteners 93 to extend through and attach to the cooling system 10. Other methods of attaching the assembly 14 to the cooling system 10 may be used as long as there is incorporated a keyed or orientation and alignment device such that the openings 62 and 68 or the slots 64 and 70 are in alignment with coolant flow openings in the cooling system 10. Other possible methods of attaching the assembly 14 to the cooling system 10 are as follows. The housing 50 may be threaded so as to thread into the cooling system. The cap 78 may have grasping hooks and twist onto a cam locking surface located on the cooling system 10, similar to that commonly used on a radiator cap design known in the art. Also, the fasteners may be replaced with metal retaining clips as to provide easy removal of the assembly 14 from the cooling system 10. The above-described attachment methods are by no measure all possible methods that may be used. Other methods may be used such that the assembly 14 is firmly held in place to keep a good liquid tight seal and maintain alignment for coolant to flow.

The thermostat retaining mechanism 55 attaches a thermostat mechanism 80 to the housing 50. The thermostat retaining mechanism 55 includes a retention ring 82 and a series of notches 84 integrally formed in the housing 50 around one end of the second portion 60. The retention ring 82 has multiple grasping hooks 86 to engage with the notches 84. The housing 50 also has a retaining ring 82, which holds a thermostat mechanism 80 within the second portion 60. Other retaining mechanisms may be used to attach the thermostat mechanism 80 to the housing 50 such as an attachment ring, a threaded fastener, a clip, a metallic band, groves in the housing 50 that the thermostat 80 may "snap" into, or various other types of attachment mechanisms know in the art. The thermostat 80 may even be press fit into the second portion 60.

The thermostat mechanism 80 is preferably a "cold-side" thermostat. A cold-side thermostat is preferred because of its known advantages over a "hot-side" thermostat. A hot-side thermostat modulates during cold temperature conditions as opposed to the cold-side thermostat, which is able to gradually adjust the temperature of the coolant flowing through the cooling system. The cold-side thermostat opens slightly during cold temperatures and opens fully during hot temperatures so as to evenly and gradually change the temperature of the coolant instead of drastically changing the temperature in a short period of time as with a hot-side thermostat. The cold-side thermostat produces a more uniform system temperature with lower temperature modulation. The cold-side thermostat is also more durable in that it experiences lower differential pressure across the center opening 66. Of course, a hot-side thermostat and other thermostat mechanisms known in the art may be used.

The releasing mechanism 54 includes a handle 79 integrally formed as part of cap 78. The handle 79 allows for easy engagement and disengagement of the housing 50 from the cooling system 10. The releasing mechanism may be of various styles, sizes, and shapes as to allow easy removal of the assembly 14.

Figure 4:
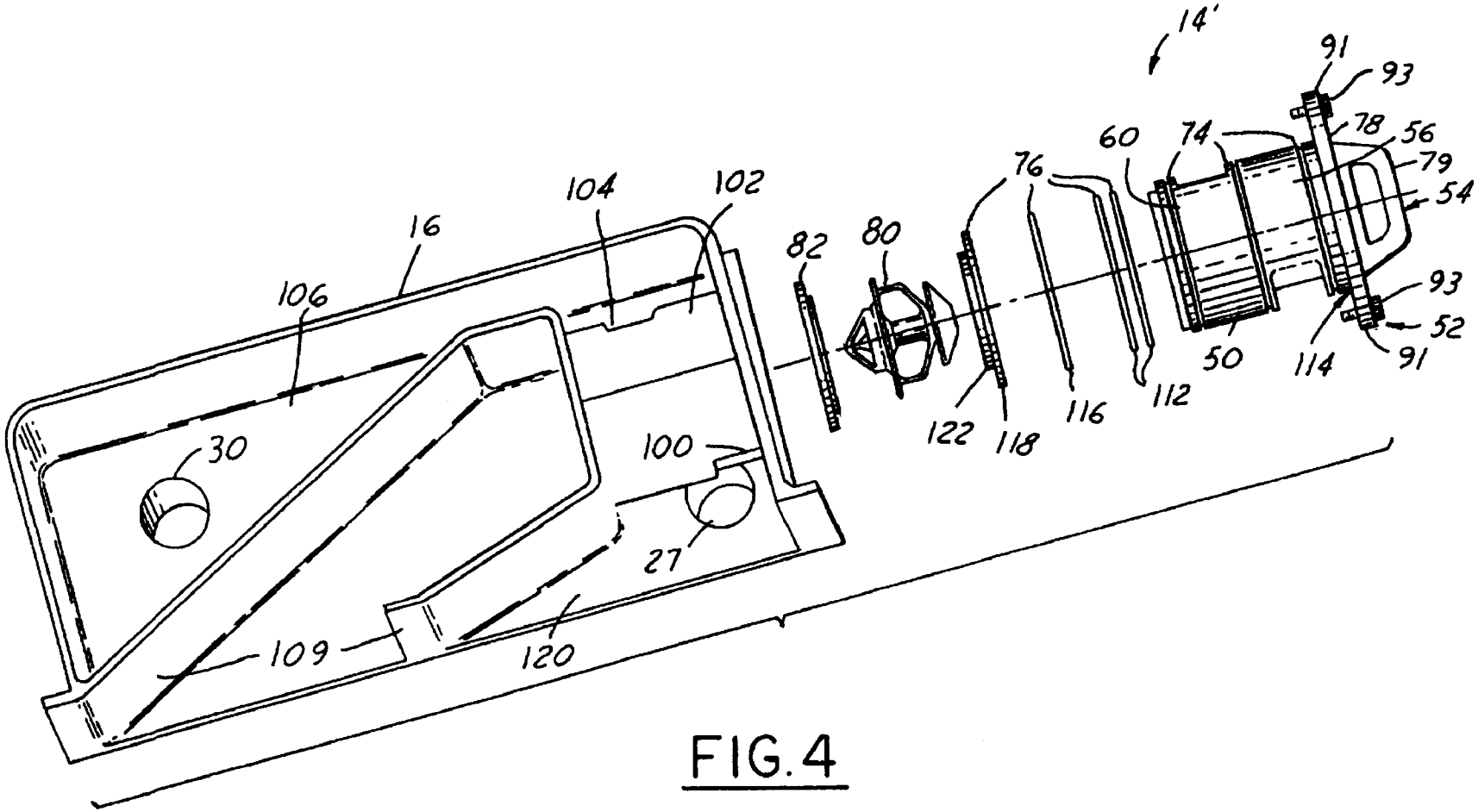
FIG. 4 is perspective component assembly view of the right-hand bypass tank incorporating the dual-opening thermostat cartridge assembly that is top-mounted and in accordance with an embodiment of the present invention.

Now referring to FIG. 4, a perspective component assembly view of the right-hand bypass tank 16 incorporating the dual-opening thermostat cartridge assembly 14", that is top-mounted, and is shown in accordance with an embodiment of the present invention. The bypass tank 16 includes the following three chambers, an exit chamber 106, a bypass chamber 120, and a direct flow chamber 121. The assembly 14" includes four O-rings 76 that are slid on to the housing 50 and set into the groves 74. The first and second O-rings 112 prevent coolant from leaking out the top periphery 114 of the cap 78. The third O-ring 116 seals the first portion 56 from the second portion 60 within a thermostat cartridge assembly holder 102. The fourth O-ring 118 seals the bypass chamber 120 from the second portion 60 within the holder 102. The holder may be integrally formed as part of the bypass tank 16, as shown. A thermostat positioning ring 122 is used to guide and position the thermostat 80 properly within the second portion 60. The ring 122 may be of any material mentioned above for the housing 50 and ring 82. The retention ring 82 as described above locks the thermostat into the second portion 60. The housing 50 is then inserted into the holder 102, such that the first opening 62 and second opening 68 are in-line with the bypass opening 100 and the exit opening 104 respectively.

Figure 5A:
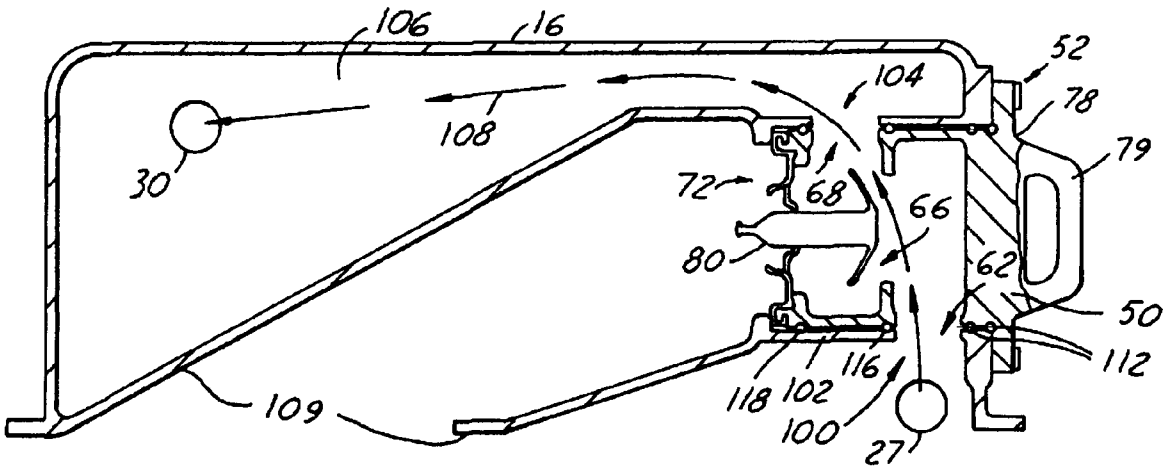
FIG. 5A is a schematic coolant flow diagram of a right-hand bypass tank incorporating the dual-opening thermostat cartridge assembly during a thermostat closed state that is in accordance with an embodiment of the present invention.

Now referring to FIG. 5A, a schematic coolant flow diagram of the right-hand bypass tank 16 incorporating the dual-opening thermostat cartridge assembly 14" during a thermostat closed state that is in accordance with an embodiment of the present invention is shown. The cold-side thermostat 80 has two operating conditions. The thermostat 80 is either in a closed state or in an open state. During the closed state the coolant flows in through the intake hole 27 through bypass opening 100 of a holder 102 and into the housing 50 through the first opening 62. The coolant passes through the center opening 66 and out the second opening 68 and exit opening 104 into the exit chamber 106 and out the exit hole 30. The closed state coolant flow path, represented by arrows 108 occurs when the coolant is at a temperature below a predetermined temperature. Baffles 109 are used in directing coolant flow and sealing off different chambers within the radiator 18.

Figure 5B:
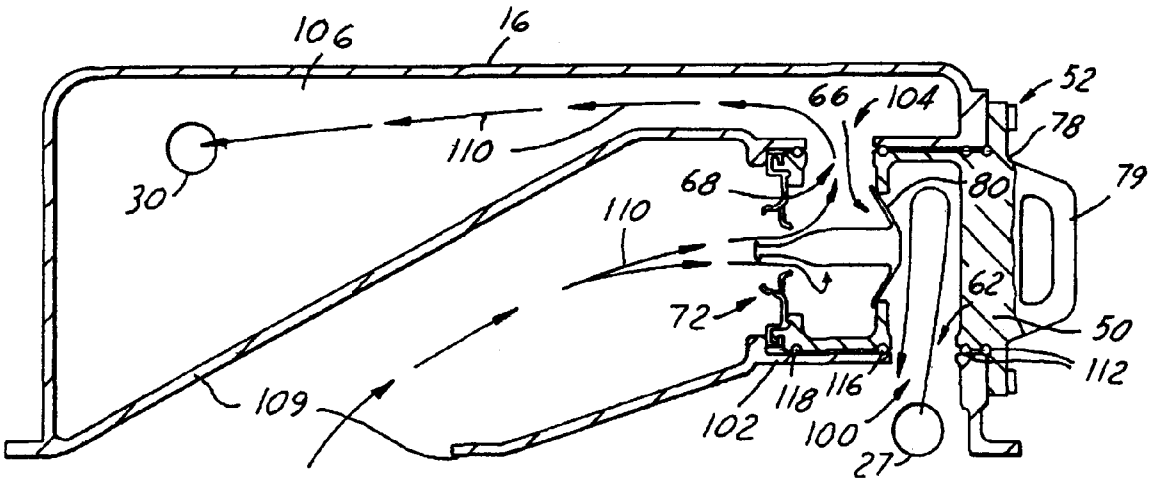
FIG. 5B is a schematic coolant flow diagram of a right-hand bypass tank incorporating the dual-opening thermostat cartridge assembly during a thermostat open state that is in accordance with an embodiment of the present invention.

Now referring to FIG. 5B, as the temperature of the coolant increases the thermostat 80 begins to open. At a full open position the thermostat 80 closes off the center opening 66 and prevents coolant from bypassing the finned tubes 34 and 35. The coolant flows through the finned tubes 34 and 35, returns through the directflow opening 72, and out the second opening 68 and exit opening 104. The open state coolant flow path is represented by arrows 110. The thermostat 80 varies its position as to regulate the amount of coolant that bypasses the finned tubes 34 and 35 or flows through the finned tubes 34 and 35.

Figure 6:
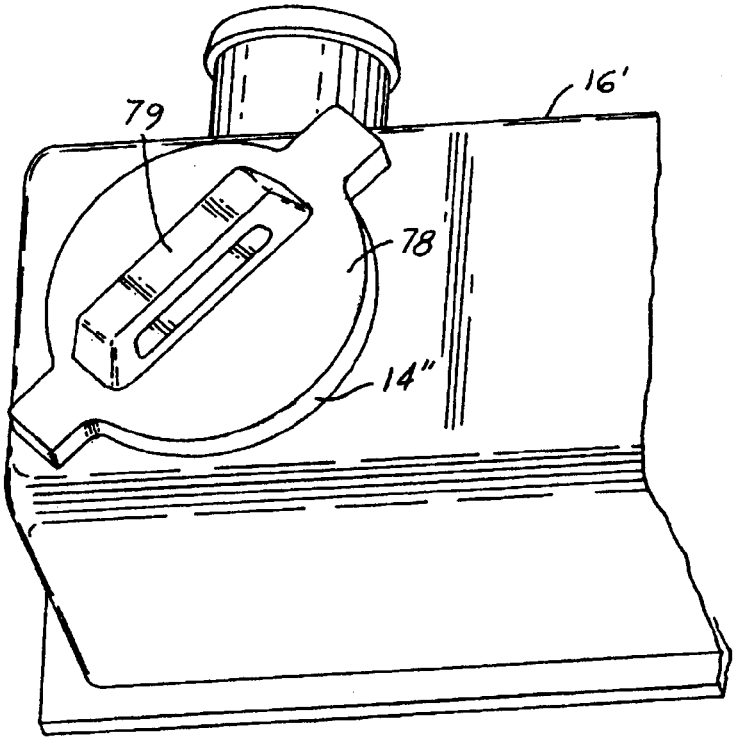
FIG. 6 is a perspective view of a left-hand bypass tank illustrating the slotted thermostat cartridge assembly that is side-mounted and inserted into the bypass tank, in accordance with an embodiment of the present invention.

FIG. 6 is a perspective view of a left-hand bypass tank 16" illustrating the slotted thermostat cartridge assembly 14"" side-mounted and inserted into the bypass tank 16", in accordance with an embodiment of the present invention. The cap 78, as illustrated, sits flush onto the side of the bypass tank 16" where it is easily accessible.

Figure 7:
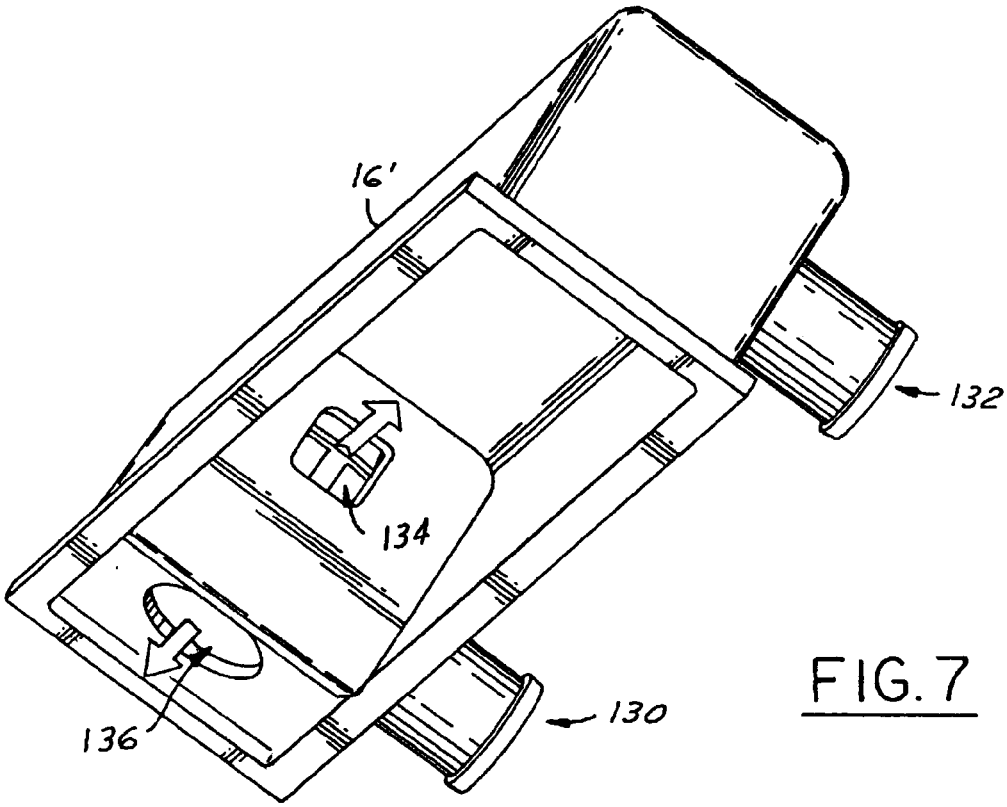
FIG. 7 is an internal perspective coolant flow diagram of the left-hand bypass tank incorporating the slotted thermostat cartridge assembly in accordance with an embodiment of the present invention.

FIGS. 3B and 7, illustrate coolant flow through the bypass tank 16" utilizing the slotted thermostat cartridge assembly 14"" in accordance with an embodiment of the present invention. During a thermostat closed state the coolant flows in through the intake hole 130, into the second portion 60 through slots 70, through the center opening 66, through the slots 64, through bypass opening 134, and out the exit hole 132. During a thermostat open state the coolant flows in through the intake hole 130, into the second portion 60, through the direct-flow opening 136 to finned tubes (not shown), and out the exit hole 132. Note the slotted assembly 14"" allows for easy alignment of the slots 64 and 70 with the bypass opening 134 and direct-flow opening 136.

Although the thermostat cartridge assembly 14 is described above as being incorporated into the bypass tank 16 of a U-flow radiator 18, the assembly 14 may be utilized in other radiator configurations. The assembly 14 may also be incorporated in various cooling system components and locations.

Utilization of the thermostat cartridge assembly into an automotive vehicle cooling system increases ease of removal and replacement of a thermostat, decreases cooling system filling time, and decreases manufacturing and repair costs.

The above-described apparatus, to one skilled in the art, is capable of being adapted for various purposes, such as: automotive cooling systems, residential or commercial cooling systems, or other liquid based systems that require regulation of fluid flow. The present invention is not limited to only these used, however. The above-described invention may also be varied without deviating from the spirit and scope of the invention as contemplated by the following claims.

What is claimed is:

1. A thermostat cartridge assembly for a cooling system of an automotive vehicle comprising:

a housing comprising;

a first opening;

a second opening; and a direct-flow opening;

a thermostat mechanism located at least partially within said housing, said thermostat mechanism adjusts the amount of the coolant flowing between said first opening, said second opening and said direct-flow opening;

an attachment mechanism attaching the thermostat cartridge assembly to the cooling system; and a releasing mechanism that engages and disengages the thermostat cartridge assembly to and from the cooling system, said releasing mechanism comprising:

a cap; and a handle mechanically coupled to said cap, said handle engages and disengages said thermostat cartridge assembly to and from said cooling system.

2. An assembly as in claim 1 wherein said first opening includes a plurality of slots.

3. An assembly as in claim 1 wherein said second opening includes a plurality of slots.

4. An assembly as in claim 1 wherein the thermostat mechanism press fits Into said thermostat cartridge assembly.

5. An assembly as in claim 1 further comprising:

two or more tabs, at least two of said two or more tabs having a hole; and two or more threaded fasteners, said fasteners extending through said holes and fastening said assembly to the cooling system.

6. An assembly as in claim 1 further comprising a thermostat retaining mechanism for holding said thermostat mechanism within the thermostat cartridge assembly.

7. An assembly as in claim 6 wherein said thermostat retaining mechanism comprises a retaining ring that attaches to said thermostat cartridge assembly.

8. A thermostat cartridge assembly for a cooling system of an automotive vehicle comprising:

a housing comprising;

a first opening;

a second opening; and a direct-flow opening;

a thermostat mechanism located at least partially within said housing, said thermostat mechanism adjusts the amount of the coolant flowing between said first opening, said second opening and said direct-flow opening;

an attachment mechanism attaching the thermostat cartridge assembly to the cooling system;

a releasing mechanism that engages and disengages the thermostat cartridge assembly to and from the cooling system; and a thermostat positioning ring for assisting in positioning said thermostat mechanism in the thermostat cartridge assembly.

9. A thermostat cartridge assembly for a cooling system of an automotive vehicle comprising:

a housing comprising;

a first portion comprising a first opening;

a center wall having a center opening; and a second portion comprising a second opening and a direct-flow opening; and a thermostat mechanism located at least partially within said housing, said thermostat mechanism adjusts the amount of the coolant flowing between said first opening, said second opening and said direct-flow opening, said thermostat mechanism adjusting the amount of coolant flowing from said first portion through said opening to said second portion;

an attachment mechanism attaching the thermostat cartridge assembly to the cooling system; and a releasing mechanism that engages and disengages the thermostat cartridge assembly to and from the cooling system.

10. An assembly as in claim 9 wherein said thermostat mechanism has an "open" state and a "closed" state.

11. An assembly as in claim 9 wherein said first portion or said second portion have a set of slots.

12. An assembly as in claim 10 wherein during said closed state said thermostat mechanism prevents coolant from flowing through said direct-flow opening when said coolant temperature is below a predetermined value.

13. An assembly as in claim 10 wherein during said open state said thermostat mechanism adjusts the amount of coolant flow through said direct-flow opening when said coolant temperature is above a predetermined value.

* * * * *